US005781939A

United States Patent [19]

Bledsoe

[11] Patent Number: 5,781,939

[45] Date of Patent: Jul. 21, 1998

[54] POTTY TRAINING CHAIR WITH CHILD RESTRAINT, ACTIVITY AREA AND AUDIBLE REWARD SYSTEM

[76] Inventor: Laurita Bledsoe, 8826 W. 7 Mile Rd., Detroit, Mich. 48221-2002

[21] Appl. No.: 780,359

[22] Filed: Jan. 9, 1997

[51] Int. Cl.[6] ..... A47K 11/04

[52] U.S. Cl. ..... 4/483; 4/479; 4/449

[58] Field of Search ..... 4/483, 479, 449, 4/480, 478, 902, 559, 476, 661; 273/157 R

[56] References Cited

U.S. PATENT DOCUMENTS

| | | | |
|---|---|---|---|
| 909,758 | 1/1909 | Collings | 4/483 |
| 1,163,263 | 12/1915 | Rudduck | 4/483 |
| 3,416,163 | 12/1968 | Jordan | 4/483 |
| 3,905,051 | 9/1975 | Gozdziewski | 4/478 |
| 4,174,544 | 11/1979 | Furusawa | 4/112 |
| 4,509,215 | 4/1985 | Paz | 4/452 |
| 4,575,882 | 3/1986 | Diamond | 4/661 |
| 4,777,680 | 10/1988 | Paz | 4/484 |
| 4,822,051 | 4/1989 | Nowak et al. | 273/157 R |
| 4,883,749 | 11/1989 | Roberts et al. | 434/247 |
| 5,008,964 | 4/1991 | Dean et al. | 4/661 |
| 5,253,375 | 10/1993 | Prosper | 4/661 |
| 5,365,496 | 11/1994 | Tolan-Samilow | 368/109 |

*Primary Examiner*—David J. Walczak
*Attorney, Agent, or Firm*—Joseph N. Breaux

[57] ABSTRACT

A potty training chair aid including a training potty including a waste receiving compartment housing having a top opening, a pivotal potty seat, and a potty lid pivotally connected to the training potty with a second pivoting hinge in a manner to be pivotal over the potty seat; a back support extending upwardly from the compartment housing; a pivoting child restraint assembly including an activity tray supported on two lockable support arms, the activity tray including a tray surface having a first plurality of geometric depressions formed therein; a second plurality of geometrically shaped activity blocks; and a cassette tape player mounted within one of the lockable support arms, the cassette tape player having control buttons extending from the support arm at a location accessible to a child seated on the potty seat. In one embodiment an audible reward system including a digital electronic audible message generating circuit having an audible message storage memory, a first pressure activated message activation switch for activating a first message, and a second pressure sensitive message activation switch for activating a second message.

12 Claims, 2 Drawing Sheets

POTTY TRAINING CHAIR WITH CHILD RESTRAINT, ACTIVITY AREA AND AUDIBLE REWARD SYSTEM

TECHNICAL FIELD

The present invention relates to potty training devices and more particularly to a potty training chair having a pivoting child restraint assembly including an activity tray, a pivotal potty seat pivotally connected adjacent to a waste receiving compartment, a pivotal potty lid pivotally connected over the potty seat, and a cassette tape player mounted within a support arm of the activity tray having control buttons extending from the support arm. An audible reward system can also be included if desired. The audible reward system includes a digital electronic audible message generating circuit having an audible message storage memory, a first pressure activated message activation switch positioned in connection with the potty lid in a manner to activate the audible message generating circuit to play a first audible message when the potty lid is raised, and a second pressure sensitive message activation switch positioned in connection with the potty seat in a manner to activate the audible message generating circuit to play a second audible message when activated by the weight of a child seated on the potty seat.

BACKGROUND OF THE INVENTION

Potty training a child can be a difficult experience for both the child and the adult charged with training the child. When potty training the child, it is often necessary to require the child to sit on a potty training chair until a potty activity has taken place. The short attention span of most small children makes the waiting period a frustrating experience for most children. As a result, it is often difficult to maintain the child on the potty seat until the potty is needed. It would be a benefit, therefore, to have a child restraint assembly in connection with a potty training chair, that would physically surround the child and prevent the child from moving off the potty seat until released by a supervising adult. To minimize stress to the restrained child, it would be a further benefit if the child restraint system included a physical activity tray position in front of the restrained child to provide the child with activities to occupy the child. Additionally, to further relieve the retrained child's stress, it would be a further benefit to have an audible attention device, such as a cassette tape player, to allow the child to listen to stories or music while restrained. To lessen the child's feeling of helplessness, it would be a still further benefit if the tape player and control buttons for the tape player were in a convenient and accessible location to the restrained child.

SUMMARY OF THE INVENTION

It is thus an object of the invention to provide a potty training chair that includes a child restraint assembly in connection with the potty training chair that physically surrounds the child and prevents the child from moving off the potty seat until released by a supervising adult.

It is a further object of the invention to provide a potty training chair that includes a child restraint assembly that includes an activity tray position in front of the restrained child to provide the child with activities to occupy the child.

It is a still further object of the invention to provide a potty training chair that includes a child restraint assembly that has an activity tray positioned in front of the restrained child that includes a cassette tape player mounted on the restraint assembly and control buttons for the tape player mounted in a convenient and accessible location to the restrained child.

It is a still further object of the invention to provide a potty training chair that includes a child restraint assembly that has an activity tray positioned in front of the restrained child that includes an audible reward system that plays a first congratulatory message when the lid of the potty chair is raised and a second congratulatory message when a child sits on the potty seat.

It is a still further object of the invention to provide a potty training chair that accomplishes all or some of the above objects in combination.

Accordingly, a child potty training chair is provided. The potty training chair includes a training potty including a waste receiving compartment housing having a top opening, a pivotal potty seat pivotally secured to the compartment housing with a first pivoting hinge, the pivotal potty seat being pivotal over the top opening, and a potty lid pivotally connected to the training potty with a second pivoting hinge in a manner to be pivotal over the potty seat; a back support extending upwardly from the compartment housing and adjacent to the first and second pivoting hinges; a pivoting child restraint assembly including an activity tray supported on two lockable support arms, the lockable support arms being pivotally secured to the back support, the activity tray including a tray surface having a first plurality of geometric depressions formed therein; a second plurality of geometrically shaped activity blocks, each of the second plurality of geometric activity blocks being of a geometric shape that corresponds to one of the first plurality of geometric depressions; and a cassette tape player mounted within one of the lockable support arms, the cassette tape player having control buttons extending from the support arm at a location accessible to a child seated on the potty seat. In a preferred embodiment, a storage compartment is provided on a side surface of the compartment housing to provide a storage area for the geometric shaped activity blocks and audio cassette tapes.

In another preferred embodiment, the potty training chair further includes an audible reward system. The audible reward system includes a digital electronic audible message generating circuit having an audible message storage memory, a first pressure activated message activation switch positioned in connection with the potty lid in a manner to activate the audible message generating circuit to play a first audible message when the potty lid is raised, and a second pressure sensitive message activation switch positioned in connection with the potty seat in a manner to activate the audible message generating circuit to play a second audible message when activated by the weight of a child seated on he potty seat.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
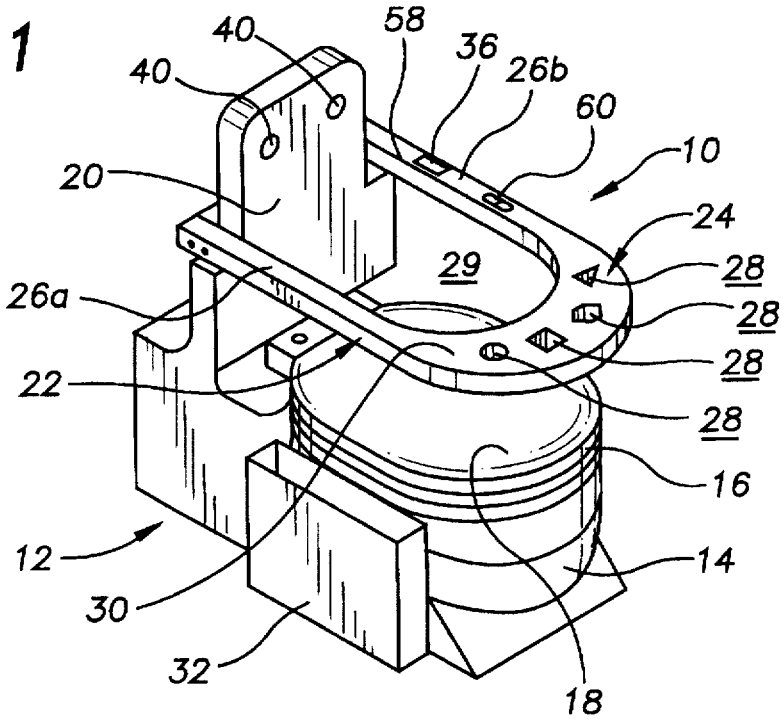
FIG. 1 is a perspective view of an exemplary embodiment of the potty training chair of the present invention showing the training potty including the waste receiving compartment housing, the pivotal potty seat, and the pivotal potty lid; the back support; the pivoting child restraint assembly including the activity tray supported on the two lockable, pivoting support arms; the four geometric depressions formed into the activity tray surface; the storage compartment for storing the geometric shaped activity blocks; and the cassette tape player mounted within one of the lockable, pivoting support arms.

FIG. 1 shows a perspective view of the potty training chair of the present invention, generally designated by the numeral 10. Potty training chair 10 includes a training potty, generally designated by the numeral 12, including a waste receiving compartment housing 14, a pivotal potty seat 16, and a pivotal potty lid 18; a back support 20 extending upwardly from compartment housing 14; a pivoting child restraint assembly, generally designated 22, including an activity tray 24 supported on two lockable, pivoting support arms **26*a*,26*b*, and four geometric depressions 28 formed into an activity tray surface 30; two locking pin assemblies 25,27 (FIG. 3); a storage compartment 32 for storing the four geometric shaped activity blocks 34 (FIG. 4); a cassette tape player 36 mounted within lockable, pivoting support arm 26*b*, and an audible reward system (generally designated 38** in FIG. 5).

Training potty 12 is of molded plastic construction. In use, training potty 12 is used as a conventional training potty by opening pivotal potty lid 18 when it is necessary to sit, and opening the pivotal potty lid 18 and the pivotal potty seat 16 when used while standing. In this embodiment, back support 20 is integrally formed with training potty 12 and is of hollow plastic construction. Two speakers 40 are mounted into back support 20 and wired to cassette player 36 and audible reward system 38.

Figure 2:
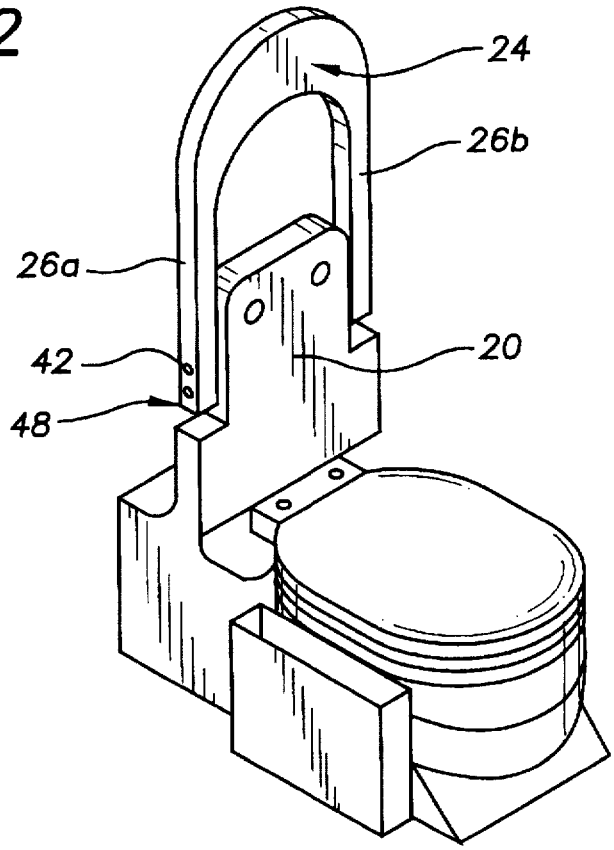
FIG. 2 is a second perspective view of the potty training chair of the present invention showing the activity tray pivoted upward on the two lockable, pivoting support arms.
Figure 3:
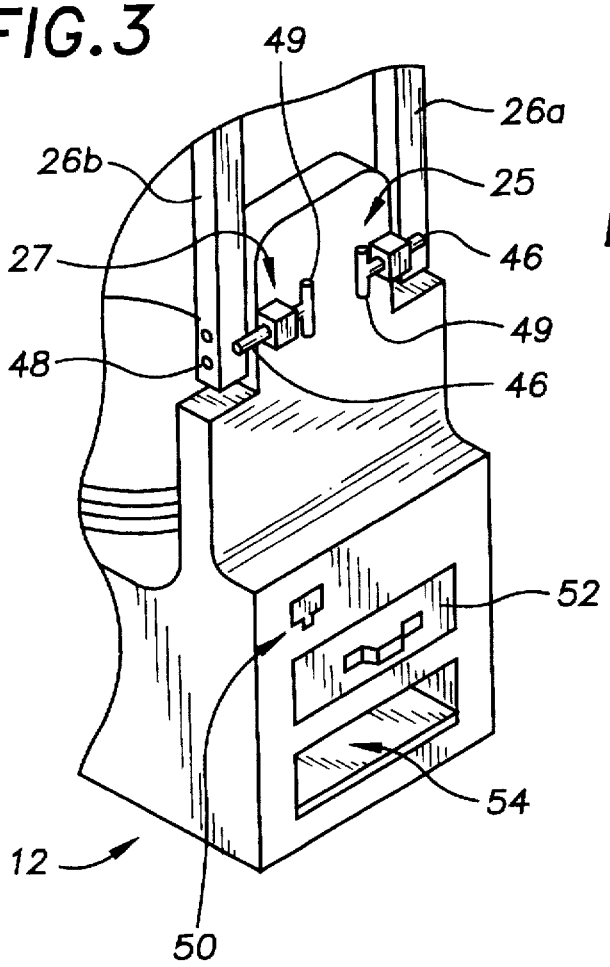
FIG. 3 is a detail perspective view of the rear side of the potty chair of the present invention showing the locking pin assemblies, the battery compartment, the waste removal drawer, and the ballast storage area.

Referring to FIG. 2, lockable support arms **26*a*,26*b* are pivotally mounted to back support 20 by pivot pins 42 (only one shown) to allow activity tray 24 to be pivot between a vertical position (shown in FIG. 2) and a horizontal position (shown in FIG. 1). With reference to FIG. 3, lockable support arms 26*a*,26*b* are lockable in the horizontal position by inserting locking pins 46 of locking pin assemblies 25,27 into the locking apertures 48 formed through the ends of lockable support arms 26*a*,26*b*. The position of locking pins 46 is adjusted by grasping pin handles 49 and sliding locking pins 46 to the desired position. Lockable support arms 26*a*,26*b* and activity tray 24 form a retraining area 29 (FIG. 1) in combination with back support 20 into which a child can be positioned and restrained when lockable support arms 26*a*,26*b* are locked in the horizontal position. Also shown in the figure are a battery compartment 50 for holding the batteries used to power cassette tape player 36 and audible reward system 38; a waste removal drawer 52 for removing waste products deposited into training potty 12; and a ballast storage area 54. Ballast storage area 54 is provided at the base of training potty 12 to provide a place to position ballast weight to prevent training potty 12 from being tipped over by a child restrained by child restraint assembly 22**.

Figure 4:
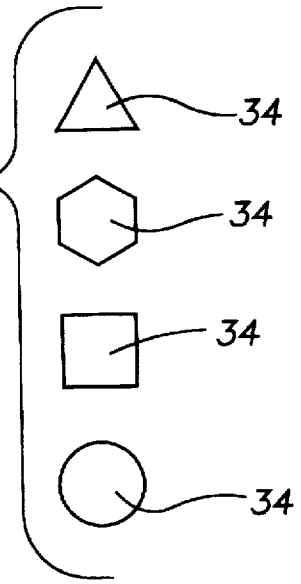
FIG. 4 is a top view of the four geometrically shaped activity blocks.

With reference to FIG. 4, in this embodiment four geometrically shaped activity blocks 34 are provided. Each activity block 34 is shaped to correspond to and fit within a single geometrically shaped depression 28. Referring back to FIG. 1, when not needed, activity blocks 34 can be stored within storage compartment 32. Storage compartment 32 is integrally formed with training potty 12. Storage compartment 32 is substantially rectangular and is provided with an open top.

Cassette tape player 36 is a convention cassette tap player having a cassette insertion opening 58 and controlled by control buttons 60 also positioned on lockable support arm **26*b***.

Figure 5:
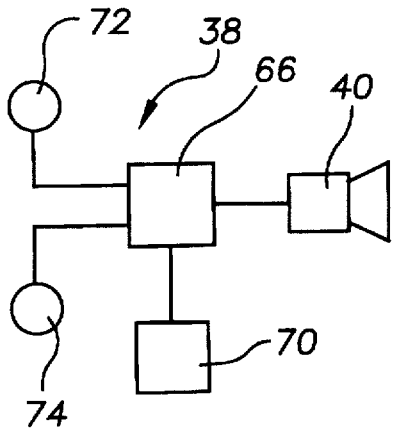
FIG. 5 is a schematic diagram of the audible reward system showing the digital electronic audible message generating circuit, the audible message storage memory, the first pressure activated message activation switch, and the second pressure activated message activation switch.
Figure 6:
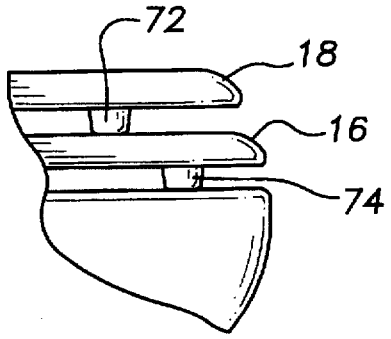
FIG. 6 is detail side view of the first pressure activated message activation switch positioned in connection with the potty lid, and the second pressure sensitive message activation switch positioned in connection with the potty seat.

Referring to FIG. 5, audible reward system 38 includes a conventional digital to analog voice circuit 66 that retrieves and plays back one of two messages stored within a conventional digital memory circuit 70. Message selection is accomplished by activation of a first or a second conventional pressure activated, momentary contact switch 72,74. FIG. 6 shows first switch 72 mounted to the underside of potty lid 18. When potty lid 18 is lifted, audible reward system plays a first audible message. Also shown in the figure is second switch 74 installed on the underside of potty seat 16. When a child sits on potty seat 16, the weight of the child activates second switch 74 causing audible reward system 38 to play the second audible message.

It can be seen from the preceding description that a potty training chair has been provided that includes a child restraint assembly in connection with the potty training chair that physically surrounds the child and prevents the child from moving off the potty seat until released by a supervising adult; that includes a child restraint assembly that includes an activity tray position in front of the restrained child to provide the child with activities to occupy the child; that includes an activity tray positioned in front of the restrained child that includes a cassette tape player mounted on the restraint assembly and control buttons for the tape player are in a convenient and accessible location to the restrained child; and that includes an audible reward system that plays a first congratulatory message when the lid of the potty chair is raised and a second congratulatory message when a child sits on the potty seat.

It is noted that the embodiment of the potty training chair described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A potty training chair comprising:

a training potty including a waste receiving compartment housing having a top opening, a pivotal potty seat pivotally secured to said compartment housing;

a back support extending upwardly from said compartment housing;

a pivoting child restraint assembly including an activity tray supported on two lockable support arms, said lockable support arms being pivotally secured to said back support, said activity tray including a tray surface having a first plurality of geometric depressions formed therein;

a second plurality of geometrically shaped activity blocks, each of said second plurality of geometric activity blocks being of a geometric shape that corresponds to one of said first plurality of geometric depressions;

a cassette tape player mounted within one of said lockable support arms, said cassette tape player having control buttons extending from said support arm at a location accessible to a child seated on said potty seat; and an audible reward system, said audible reward system including a digital electronic audible message generating circuit having an audible message storage memory, a first pressure activated message activation switch positioned in connection with said potty lid in a manner to activate said audible message generating circuit to play a first audible message when said potty lid is raised, and a second pressure sensitive message activation switch positioned in connection with said potty seat in a manner to activate said audible message generating circuit to play a second audible message when activated by said weight of a child seated on said potty seat.

2. The potty training chair of claim 1, wherein:

a storage compartment is provided on a side surface of said compartment housing to provide a storage area for said geometric shaped activity blocks.

3. The potty training chair of claim 2 wherein:

said back support is integrally formed with said training potty and has two speakers mounted therein, said two speakers being in electrical connection with said cassette player.

4. The potty training chair of claim 3 further including:

two locking pin assemblies mounted to a back surface of the back support, each said locking pin assembly including a slidable locking pin; and wherein:

said lockable support arms are each pivotally mounted to said back support by a pivot pin and have a locking aperture formed through an end thereof, each said lockable support arms being lockable in a horizontal position by inserting one of said locking pins into one of said locking apertures.

5. The potty training chair of claim 2 further including:

two locking pin assemblies mounted to a back surface of the back support, each said locking pin assembly including a slidable locking pin; and wherein:

said lockable support arms are each pivotally mounted to said back support by a pivot pin and have a locking aperture formed through an end thereof, each said lockable support arms being lockable in a horizontal position by inserting one of said locking pins into one of said locking apertures.

6. The potty training chair of claim 1 wherein:

said back support is integrally formed with said training potty and has two speakers mounted therein, said two speakers being in electrical connection with said cassette player.

7. The potty training chair of claim 6 further including:

two locking pin assemblies mounted to a back surface of the back support, each said locking pin assembly including a slidable locking pin; and wherein:

said lockable support arms are each pivotally mounted to said back support by a pivot pin and have a locking aperture formed through an end thereof, each said lockable support arms being lockable in a horizontal position by inserting one of said locking pins into one of said locking apertures.

8. The potty training chair of claim 1 further including:

two locking pin assemblies mounted to a back surface of the back support, each said locking pin assembly including a slidable locking pin; and wherein:

said lockable support arms are each pivotally mounted to said back support by a pivot pin and have a locking aperture formed through an end thereof, each said lockable support arms being lockable in a horizontal position by inserting one of said locking pins into one of said locking apertures.

9. A potty training chair comprising:

a training potty including a waste receiving compartment housing having a top opening, a pivotal potty seat pivotally secured to said compartment housing;

a back support extending upwardly from said compartment housing;

a pivoting child restraint assembly including an activity tray supported on two lockable support arms, said lockable support arms being pivotally secured to said back support, said activity tray including a tray surface having a first plurality of geometric depressions formed therein;

a second plurality of geometrically shaped activity blocks, each of said second plurality of geometric activity blocks being of a geometric shape that corresponds to one of said first plurality of geometric depressions;

a cassette tape player mounted within one of said lockable support arms, said cassette tape player having control buttons extending from said support arm at a location accessible to a child seated on said potty seat; and two locking pin assemblies mounted to a back surface of the back support, each said locking pin assembly including a slidable locking pin; and wherein:

said lockable support arms are each pivotally mounted to said back support by a pivot pin and have a locking aperture formed through an end thereof, each said lockable support arm being lockable in a horizontal position by inserting one of said locking pins into one of said locking apertures.

10. The potty training chair of claim 9 wherein:

said back support is integrally formed with said training potty and has two speakers mounted therein, said two speakers being in electrical connection with said cassette player.

11. The potty training chair of claim 9, wherein:

a storage compartment is provided on a side surface of said compartment housing to provide a storage area for said geometric shaped activity blocks.

12. The potty training chair of claim 11 wherein:

said back support is integrally formed with said training potty and has two speakers mounted therein, said two speakers being in electrical connection with said cassette player.

* * * * *